US011820590B2

(12) United States Patent
Beegle

(10) Patent No.: US 11,820,590 B2
(45) Date of Patent: Nov. 21, 2023

(54) GARBAGE BAG STORAGE AND DISPENSING SYSTEM

(71) Applicant: Christopher E. Beegle, New Paris, PA (US)

(72) Inventor: Christopher E. Beegle, New Paris, PA (US)

( * ) Notice: Subject to any disclaimer, the term of this patent is extended or adjusted under 35 U.S.C. 154(b) by 0 days.

(21) Appl. No.: 17/651,929

(22) Filed: Feb. 22, 2022

(65) Prior Publication Data

US 2022/0356011 A1 Nov. 10, 2022

Related U.S. Application Data

(60) Provisional application No. 63/201,541, filed on May 4, 2021.

(51) Int. Cl.
*B65F 1/06* (2006.01)

(52) U.S. Cl.
CPC ..... *B65F 1/062* (2013.01); *B65F 1/065* (2013.01)

(58) Field of Classification Search
CPC ..... B65F 1/00; B65F 1/04; B65F 1/06; B65F 1/062; B65F 1/065; B65F 1/067
See application file for complete search history.

(56) References Cited

U.S. PATENT DOCUMENTS

| | | | | |
|---|---|---|---|---|
| 4,364,490 | A * | 12/1982 | Lang | B65F 1/062 206/390 |
| 8,807,379 | B1 * | 8/2014 | Hammond | B65F 1/062 220/495.07 |
| 2006/0169697 | A1 * | 8/2006 | Koch | B65F 1/062 220/495.07 |
| 2015/0321841 | A1 * | 11/2015 | Salas | B65F 1/067 220/495.07 |

* cited by examiner

*Primary Examiner* — Javier A Pagan

(74) *Attorney, Agent, or Firm* — Dunlap Bennett & Ludwig, PLLC

(57) ABSTRACT

A garbage bag storage and dispensing assembly and system is herein disclosed. The system includes a garbage can, a bag holder slidably mounted at a bottom of the garbage can, and a plurality of garbage bags. In use, the garbage bags are rotatably provided in the bag holder and are slid through a slit defined in the garbage can to sequentially dispense them. Thus, the garbage bags can be provided as an integrated piece of the garbage can, and can easily be accessed by a user when needed.

6 Claims, 4 Drawing Sheets

GARBAGE BAG STORAGE AND DISPENSING SYSTEM

CROSS-REFERENCE TO RELATED APPLICATION

This application claims the benefit of priority of U.S. provisional application No. 63/201,541, filed May 4, 2021, the contents of which are herein incorporated by reference.

BACKGROUND OF THE INVENTION

The present invention relates to garbage cans and, more particularly, to a refillable garbage system that generally provides garbage bags at a base of a kitchen garbage can to easily reload the garbage can when a new bag is needed.

Garbage cans conventionally hold a single garbage bag that is mounted around an upper rim of the garbage can. Replacement garbage bags, for use after the present bag is full, are typically stored remotely from the garbage can.

As garbage cans are frequently used, they are constantly in need of removal and replacement of garbage bags. Consequently, users need to frequently change the garbage bags at regular intervals, many times more than once a week. Thus, every time a user needs to replace a garbage bag, a new one must be procured from where it is being stored, resulting in additional effort and time by the user. In many instances, this storage location could be in another room or, at the very least, across the room in, for example, a storage closet.

While some users may toss a garbage bag or two at the bottom of a trash can, that is a sub-optimal solution that has many of the aforementioned pitfalls (e.g., in constant need of replacement, and the need for extra physical exertion to bend down to reach the garbage bag).

As can be seen, there is a need for the present invention, which provides refillable bags in a kitchen garbage can.

SUMMARY OF THE INVENTION

In one aspect of the present invention, a garbage bag storage and dispensing system comprises: a garbage can defining a garbage bag opening for receiving a garbage bag, an upper portion, and a lower portion, wherein the upper portion comprises a garbage can lip, and wherein the lower portion comprises a false bottom that defines a slit therethrough and a bag holder slot, with the slit connecting the garbage bag opening and the bag holder slot; a bag holder movably received within the bag holder slot; and a plurality of garbage bags operably coupled to one another, mounted in the bag holder, and configured to be sequentially slid through the slit.

In another aspect of the present invention, a garbage bag storage and dispensing assembly comprises: a garbage can defining a garbage bag opening for receiving a garbage bag, an upper portion, and a lower portion, wherein the upper portion comprises a garbage can lip, and wherein the lower portion comprises a false bottom that defines a slit therethrough and a bag holder slot, with the slit connecting the garbage bag opening and the bag holder slot; and a bag holder movably received within the bag holder slot and configured to have a plurality of garbage bags mounted therein.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
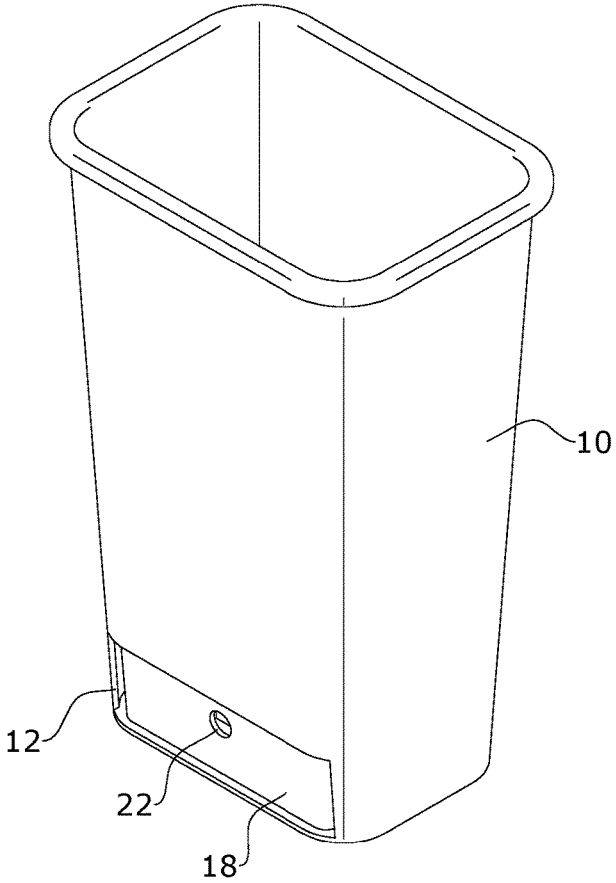
FIG. 1 is a perspective view of an embodiment of the present invention.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details.

Broadly, an embodiment of the present invention provides a garbage can system including: (1) a garbage can including a bottom end and a slit proximal the first end and (2) a bag holder disposed at the bottom end. The bag holder is designed to open to load a plurality of garbage bags therewithin, and the plurality of garbage bags are configured to be slid through the slit in the garbage can, in use.

Embodiments of the present invention solve the aforementioned problems with a refillable bag system. The present invention is unique, for example, because it provides for automatic pull up and renewal/replacement of the garbage bags. Consequently, there is no need for replacement of garbage bags one at a time. Embodiments of the present invention utilizes numerous bags on a roll, housed within the garbage can, such that they can be selectively pulled up from the bottom when needed.

Referring now to FIGS. 1-8, numerous specific details are set forth in the following description in order to provide a thorough understanding of the invention. However, the invention may be practiced according to the claims without some or all of these specific details. For the purpose of clarity, technical material that is known in the technical fields related to the present invention has not been described in detail so that the present invention is not unnecessarily obscured.

As shown in FIGS. 1-8, embodiments of the present invention generally include three primary components: a garbage container 10, a bag holder 18 (functioning as a drawer/bin), and a multi-bag roll of garbage bags 24 (also referred to as, for example, trash liners).

Figure 7:
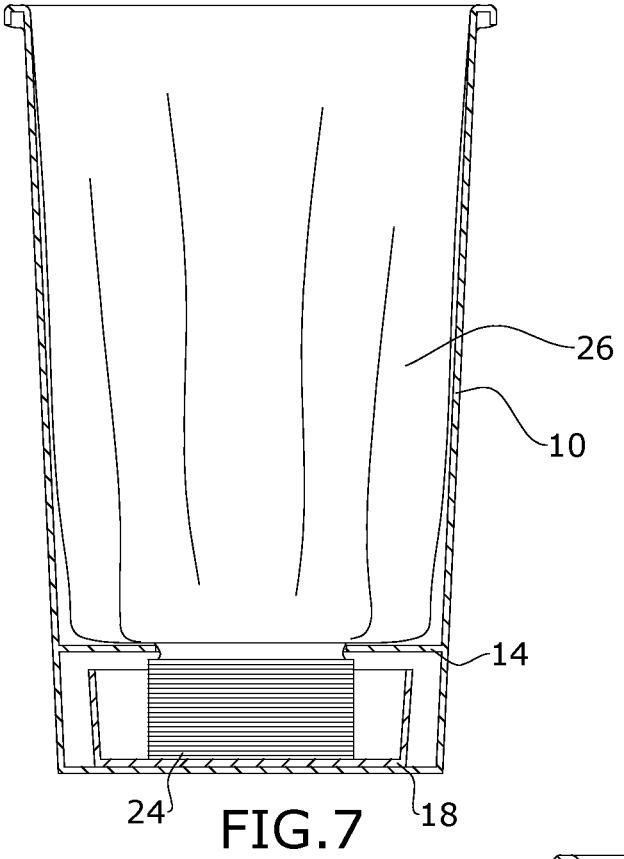
FIG. 7 is a section view of the embodiment of the present invention, similar to FIG. 5 and showing the first garbage bag (shown in full for clarity) being fully lifted and positioned in the garbage can.

The garbage container 10 generally includes an upper portion and a lower portion. The upper portion and lower portion define a large opening in which garbage bags are mounted to receive garbage. The upper portion generally defines an upper lip/rim for supporting the garbage bag (as shown in FIG. 7). The lower portion defines a bag holder slot 12 and a false bottom 14 with a slit/slot 16 defined therethrough.

Figure 2:
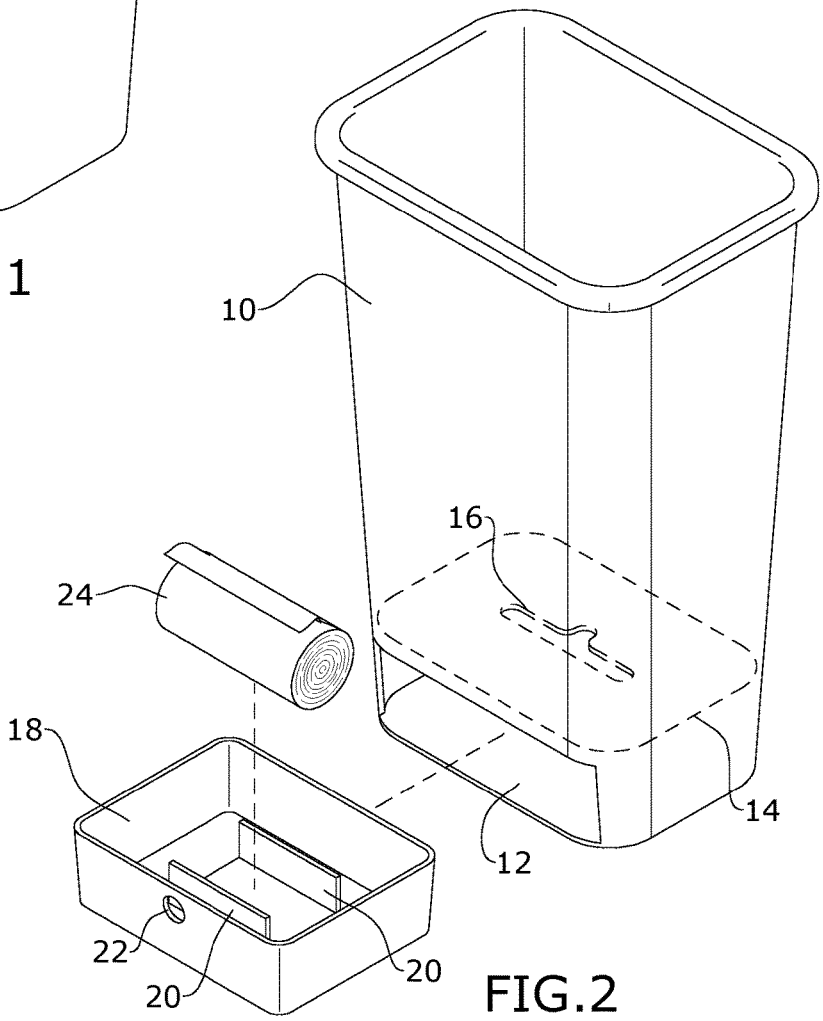
FIG. 2 is an exploded view of the embodiment of the present invention.
Figure 3:
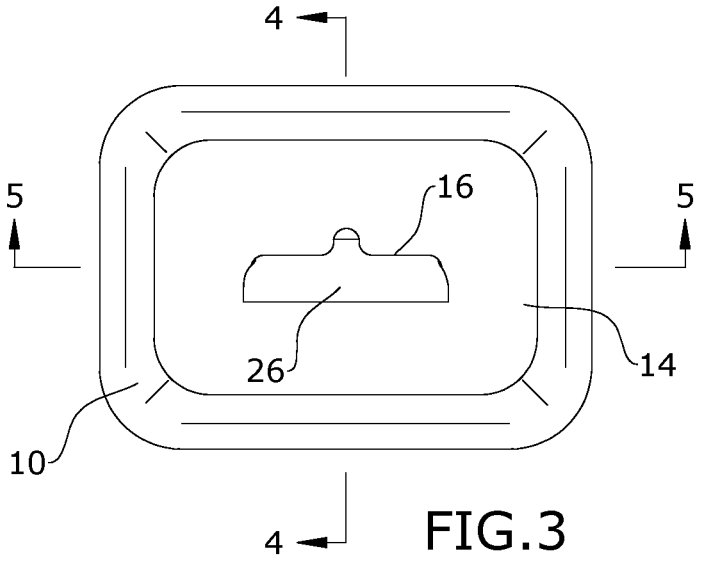
FIG. 3 is a top view of the embodiment of the present invention.

As shown in FIGS. 1 and 2, the bag holder 18 may be embodied as a drawer slidably provided at a bottom end of the garbage container 10. The bag holder 18 defines a compartment in which a bag roller 20 is mounted. The bag roller 20 is provided for storage and support of the multi-bag roll 24 of garbage bags. The bag roller 20 maintains the roll 24 substantially in place so it cannot slide around the bag holder 18 (i.e., it is only allowed to rotate, as described in greater detail below). The bag holder 18 further defines a hole 22 which users can put their fingers through to grasp and manipulate the holder 18.

The bag holder 18 and garbage container 10 form a unitary garbage can and bag holder system, with the bag holder storing the garbage bags 26 out of sight while permitting easy access thereto.

Figure 4:
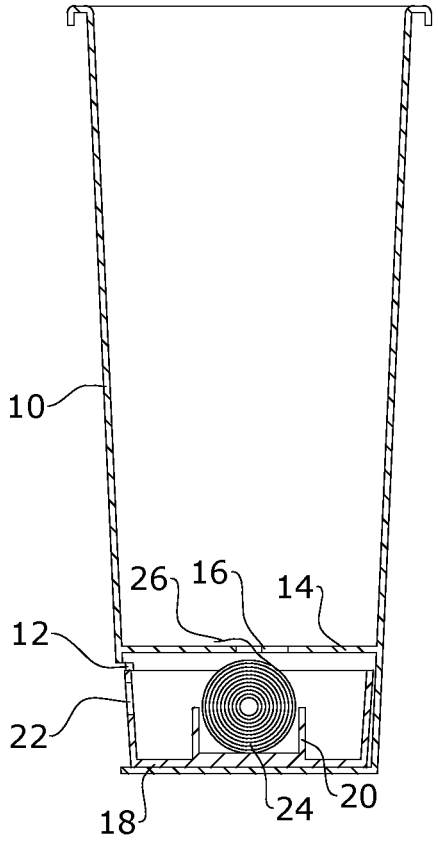
FIG. 4 is a section view of the embodiment of the present invention, taken along line 4-4 in FIG. 3.
Figure 5:
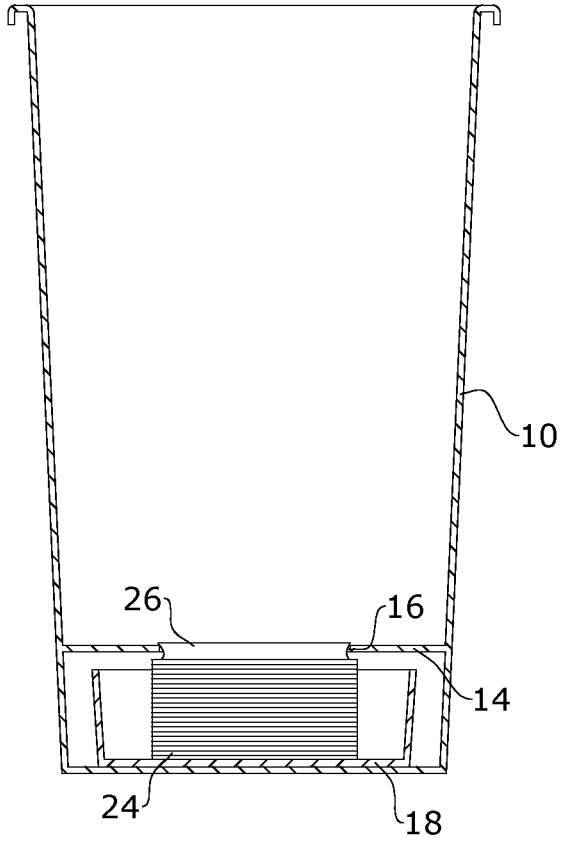
FIG. 5 is a section view of the embodiment of the present invention, taken along line 5-5 in FIG. 3.
Figure 6:
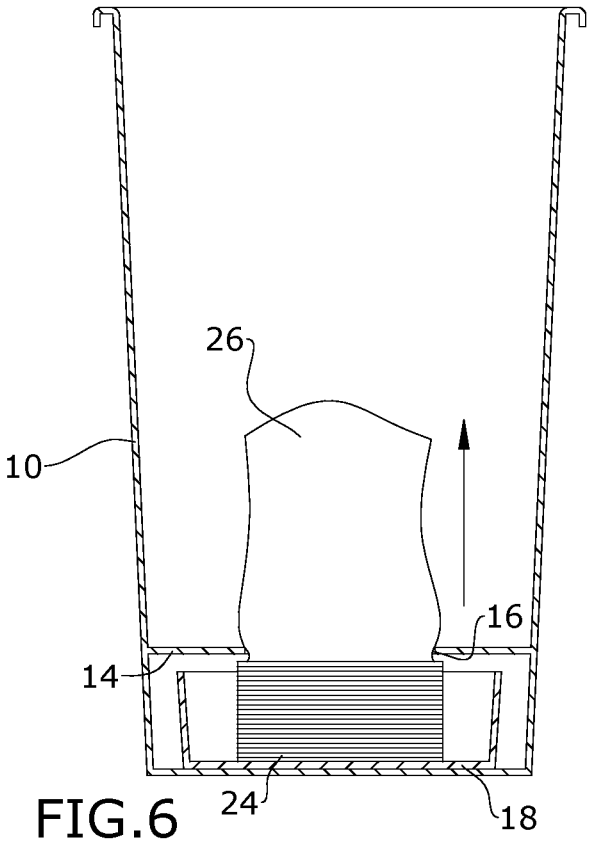
FIG. 6 is a section view of the embodiment of the present invention, similar to FIG. 5 and showing a first garbage bag (shown in full for clarity) being lifted.
Figure 8:
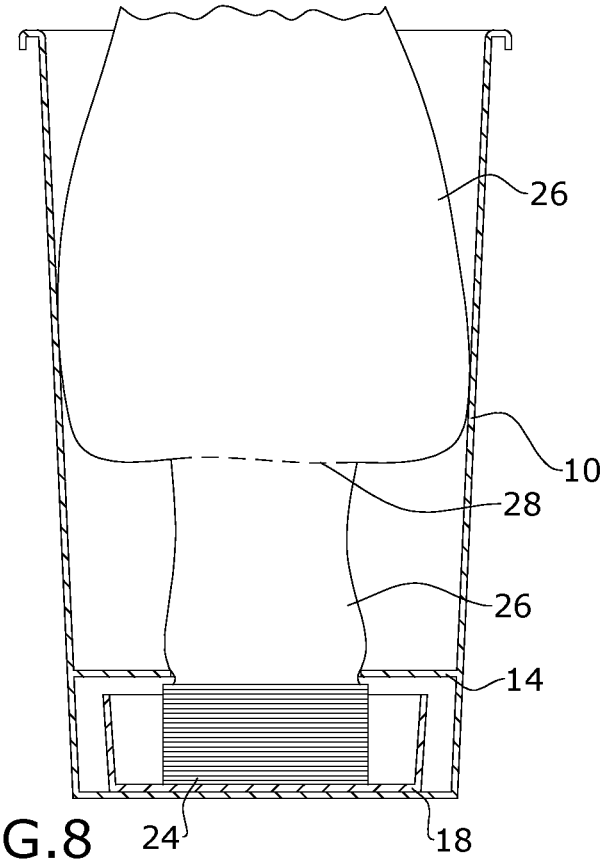
FIG. 8 is a section view of the embodiment of the present invention, similar to FIG. 5 and showing the first garbage bag (which is full) being lifted out of the garbage can to raise a second garbage bag, with the garbage bags shown in full for clarity.

To use, the bag holder 18 is pulled out from the garbage container 10, as shown in FIG. 2. A garbage bag roll 24 is mounted in the bag roller 20, and the bag holder 18 is slid back into the bag holder slot 12, as shown in FIG. 1. A first garbage bag 26 is fed through the slit 16, as shown in FIG. 4. Alternatively, the first garbage bag 26 can first be fed through the slit 16, followed by sliding closed of the bag holder 18. As shown from FIGS. 6 to 7, the first garbage bag 26 can be pulled up and positioned over the lip on the garbage container 10. Thus, the first garbage bag is ready for use. As shown in FIG. 8, the garbage bags 28 on the roll 24 may be separated by perforations 28. Thus, upwards pulling of the first garbage bag 26 (the upper one in FIG. 8) results in the roll 24 spinning and a second garbage bag 26 (the lower one shown in FIG. 8) being pulled upwards through the slit 16. This provides easy access to the second garbage bag 26 (e.g., no leaning down or retrieval from another location is required). The first garbage bag 26 can then be pulled off at the perforation 28, and the second garbage bag 26 wrapped around the lip of the garbage container 10. This method can be repeated until the roll 24 is exhausted and a new roll 24 is positioned in the bag holder 18.

While the present invention is described in the context of a roll 24, those with skill in the art will appreciate that the roll 24 may take other configurations than a plurality of bags 26 wrapped in a circular direction. For example, the roll 24 may be alternatively embodied as a stack of bags 26 accordion-style folded and connected by perforations. In such an embodiment, the operation of the system would remain the same.

Various appropriate processes to make embodiments of the present invention may be used and would be readily apparent to those with skill in the art from the foregoing. For example, the bag holder 18 and the garbage container 10 may be plastic injection molded. The garbage bags 26 may be blown and assembled by an appropriate manufacturer.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

What is claimed is:

1. A garbage bag storage and dispensing system comprising:

a garbage can defining a garbage bag opening for receiving a garbage bag, an upper portion, and a lower portion, wherein the upper portion comprises a garbage can lip, and wherein the lower portion comprises a false bottom that defines a slit therethrough and a bag holder slot, with the slit connecting the garbage bag opening and the bag holder slot;

a bag holder movably received within the bag holder slot, wherein the bag holder comprises two side walls, a front wall, and back wall defining a compartment;

a bag roller located in the compartment, wherein the bag roller comprises two support panels perpendicularly extending from a bottom surface of the bag holder so that the two support panels are spaced apart from each other, parallel to each other, and disconnected from each other along their respective upper portions; and a plurality of garbage bags operably coupled to one another, mounted in the bag roller, and configured to be sequentially slid through the slit, whereby mounting of the plurality of garbage bags comprises lowering said plurality of garbage bags between the two support panels.

2. The garbage bag storage and dispensing system of claim 1, wherein the bag holder is slidably received within the bag holder slot.

3. The garbage bag storage and dispensing system of claim 1, adjacent garbage bags of the plurality of garbage bags comprise perforations therebetween for separating the adjacent bags.

4. The garbage bag storage and dispensing system of claim 1, wherein a first garbage bag of the plurality of garbage bags is positioned over the garbage can lip within the garbage bag opening.

5. The garbage bag storage and dispensing system of claim 4, whereby movement of the first garbage bag upwards out of the garbage bag opening results in a second garbage bag of the plurality of garbage bags being pulled through the slit and into the garbage bag opening.

6. The garbage bag storage and dispensing system of claim 5, wherein the first garbage bag and the second garbage bag are detachably connected via perforations.

* * * * *